US007051648B2

(12) United States Patent
Fenaroli

(10) Patent No.: US 7,051,648 B2
(45) Date of Patent: May 30, 2006

(54) DEVICE FOR MAKING BEVERAGE

(76) Inventor: Matthew A. Fenaroli, 100 E. Royal St., Raymore, MO (US) 64083

( * ) Notice: Subject to any disclaimer, the term of this patent is extended or adjusted under 35 U.S.C. 154(b) by 597 days.

(21) Appl. No.: 10/267,675

(22) Filed: Oct. 10, 2002

(65) Prior Publication Data

US 2004/0069148 A1 Apr. 15, 2004

(51) Int. Cl.
*B65B 25/08* (2006.01)

(52) U.S. Cl. ..... 99/321; 99/322; 99/323; 426/77; 426/82

(58) Field of Classification Search ..... 99/323, 99/321, 319, 322; 426/77, 112, 82, 83, 115; 215/DIG. 8; 206/219, 222; 222/80, 129
See application file for complete search history.

(56) References Cited

U.S. PATENT DOCUMENTS 234,556 A * 11/1880 Fitzgerald ..... 99/320
2,086,073 A 7/1937 Francescon
2,133,166 A * 10/1938 Fritsche ..... 99/323
3,039,644 A 6/1962 Lefcort
3,275,448 A 9/1966 Sommer
3,657,994 A 4/1972 Post
3,743,520 A 7/1973 Croner
4,167,899 A 9/1979 McCormick
4,333,581 A 6/1982 Flansburg
4,821,630 A 4/1989 Roberts
5,424,083 A 6/1995 Lozito
5,456,929 A 10/1995 Mifune et al.
5,678,472 A 10/1997 Millman
5,952,028 A 9/1999 Lesser
5,984,141 A * 11/1999 Gibler ..... 222/80
6,007,853 A 12/1999 Lesser
6,059,443 A * 5/2000 Casey ..... 366/130
6,269,736 B1 8/2001 Melton
6,283,013 B1 9/2001 Romandy et al.
6,372,270 B1 4/2002 Denny
6,541,055 B1 * 4/2003 Luzenberg ..... 426/433
6,669,013 B1 * 12/2003 Villanueva ..... 206/219
6,854,595 B1 * 2/2005 Kiser ..... 206/222

* cited by examiner

*Primary Examiner*—Reginald L. Alexander
(74) *Attorney, Agent, or Firm*—Richard C. Litman

(57) ABSTRACT

A device for making a beverage, such as tea, in a container, such as a standard two liter bottle. The device has a bag for holding a beverage component, and a securing device for securing the bag in the container. The device also has either a planar element for holding or suspending the device in the container, a supplemental attachment device for attaching a bag to a supplemental bag in series, or a rigid frame where the bag is disposed inside the rigid frame. The container has an opening and the bag is adapted to be inserted through and removed from the opening without the bag contacting the opening.

16 Claims, 10 Drawing Sheets

DEVICE FOR MAKING BEVERAGE

BACKGROUND OF THE INVENTION

1. Field of the Invention

The present invention relates to a device for making a beverage in a container. For example, the device may be used to make tea in a standard two liter bottle.

2. Description of Related Art

Teas and drink mixes are often packaged in relatively flat paper bags which are placed in water and allowed to steep or dissolve in water. When making tea, it is not generally desirable to steep the tea bag in the water for too long a time as the tea becomes bitter. A string with a paper tab is typically attached to the bag for securing the bag in a container and removing the tea bag once the tea is at the desired strength. There are many problems in using this kind of paper bag to make a beverage. When opening a conventional tea bag, it is easy to inadvertently rip the paper tab off the string or the string off the bag. When this happens, the bag or bags drop to the bottom of the container making them difficult to remove. This is particularly problematic when using hot liquids and/or a deep container.

When making sun tea, large glass containers are often used, filled with water and tea bags, and placed in the sun to steep. This kind of container typically has a 4" diameter mouth, holds 2–3 gallons of water, and has a valve built into the bottom of a glass or plastic jar. The valves leak and are prone to contamination. It is not practical or cost-effective to fix a faulty valve, so the entire container must be disposed and replaced. Also, the containers are heavy and cumbersome, especially when full. When made of glass, the containers are prone to shatter. These risks are particularly bothersome when children are present.

Conventional tea bags cannot fit inside of containers with small diameter openings. Also, conventional tea bags tend to expand and settle when they are exposed to water, making them difficult to easily remove from containers with small diameter openings.

A variety of devices have been proposed for making beverages in containers; however, none teach or suggest all the features of the present invention. None of the proposed devices teaches or suggests a device for making a beverage comprising a bag where the bag is dimensioned and configured for insertion and removal through a mouth of a container without the bag contacting the mouth and either a planar element, a supplemental attachment device for attaching a bag to a supplemental bag in series, or a rigid frame where the bag is disposed inside the rigid frame.

U.S. Pat. No. 2,086,073, issued Jul. 6, 1937 to D. L. Francescon, discloses a device for aging whiskey in glass containers with a glass tube for holding charcoal cubes. The Francescon glass tube is rigid, is used to hold charcoal and is not used to hold a beverage component. U.S. Pat. No. 3,039,644, issued Jun. 19, 1962 to M. Lefcort, discloses a compartmented beverage container, particularly for carbonated beverages. The Lefcort container has compartments for liquids and for gases. The walls between the compartments are generally rigid. U.S. Pat. No. 3,275,448, issued Sep. 27, 1966 to G. R. Sommer, discloses a hand-held comestibles container with water soluble product therein. The Sommer container is rigid and has no means of securing the container to the coffee cup.

U.S. Pat. No. 3,657,994, issued Apr. 25, 1972 to Post, discloses a combination container and dispenser. The Post container is rigid and is attached to a cup with a simple hook-shaped clip. U.S. Pat. No. 3,743,520, issued Jul. 3, 1973 to J. T. Croner, discloses a compartmented beverage container. The Croner container includes rigid compartments which can be ruptured. The Croner-compartments are hung inside the container. U.S. Pat. No. 4,167,899, issued Sep. 18, 1979 to McCormick, discloses a disposable unitary coffee maker with a coffee charge stored in a coffee holder wrap.

U.S. Pat. No. 4,333,581, issued Jun. 8, 1982 to Flansburg, discloses a multi-compartment container with pop-top and communicating door. The Flansburg container has a rigid separate compartment for storing a mixer. U.S. Pat. No. 4,821,630, issued Apr. 18, 1989 to Roberts, discloses a sun tea adapter for plastic cartons which is adapted to fit milk cartons. U.S. Pat. No. 5,424,083, issued Jun. 13, 1995 to Lozito, discloses a self contained disposable coffee brewing device with a basket. The Lozito basket has a flange that rests on the top surface of a coffee cup.

U.S. Pat. No. 5,456,929, issued Oct. 10, 1995 to Mifune et al., discloses ready-to-heat canned goods. Mifune discloses various cans with capsule bodies or bag-shaped members which open at a predetermined temperature. U.S. Pat. No. 5,678,472, issued Oct. 21, 1997 to Millman, discloses a decoction apparatus with a tea bag retainer for submerging tea bags. U.S. Pat. Nos. 5,952,028 and 6,007,853, issued Sep. 14, 1999 and Dec. 28, 1999 to Lesser, disclose a disposable beverage infuser. The Lesser infusers have a porous filter which contains beverage material.

U.S. Pat. No. 6,269,736, issued Aug. 7, 2001 to Melton, discloses an infuser filter for making beverages. The Melton infuser includes a well portion for holding particulate flavoring material. U.S. Pat. No. 6,283,013, issued Sep. 4, 2001 to Romandy et al., discloses a tea steeper for a coffeemaker which rests on the top of a carafe. U.S. Pat. No. 6,372,270, issued Apr. 16, 2002 to Denny, discloses a drink mix apparatus for making personal quantities of beverage where tea bags are stored in a cap with a plunger device.

None of the above inventions and patents, taken either singly or in combination, is seen to describe the instant invention as claimed. Thus a device for making a beverage solving the aforementioned problems is desired.

SUMMARY OF THE INVENTION

The present invention is a device for making a beverage in a container. The device may be reusable, recyclable or adapted for a single use. The device may be used with a new or used container. The device comprises a bag for holding a beverage component, and a means for securing the bag in the container. The container has an opening, and the bag is adapted to be inserted through and removed from the opening without the bag contacting the opening. The bag may be provided in any suitable shape. The container may be a standard two liter bottle, and the opening may be a standard opening for the standard two liter bottle.

The bag may further comprise a supplemental attachment device for attaching the bag to a supplemental bag in series. The supplemental attachment device may be, for instance, a frangible or perforated connector, a threaded connector, a snap fit connector, a ball and socket connector, a male-female connector, a clipped connector, a hook and hole connector, or the like. By providing the device with the supplemental attachment device and the supplemental bag, a user can adjust the strength of the resulting beverage and/or provide a sufficient amount of beverage component for a particular size batch of beverage. The bag may comprise a plurality of compartments which are wound about a shaft. The bag may comprise a plurality of units with a frangible or perforated connector between each unit. The device may further comprise a rigid container with a plurality of openings.

The device may further comprise a connector for connecting the bag to the means for securing. The connector may be, for instance, a frangible or perforated connector, a threaded connector, a snap fit connector, a ball and socket connector, a male-female connector, a clipped connector, a hook and hole connector, or the like. The connector may comprise a two piece connector with an upper member attached to the means for securing and a lower member attached to the bag, or vice-versa.

The means for securing may comprise a hook and the bag is hung from the hook. The means for securing may comprise a generally cylindrical base and a plurality of axially and radially extending fingers which is adapted to fit a wide variety of container openings. Each finger of the plurality of fingers comprises an axial portion which extends axially upward from the base and a radial portion which extends radially outward from the axial portion. The radial portion rests on a top surface of the opening of the container while permitting the bag to be inserted through and removed from the opening. The means for securing may comprise a planar element. The planar element may be adapted to fit inside a cap for the container. The means for securing may comprise a replacement cap which may be adapted to fit the container. The means for securing may comprise a hollow cylindrical member with an axially inner surface. A plurality of flexible inwardly extending fins are provided radially on the axially inner surface, and the fins are adapted to catch and releasably hold the bag.

Alternately, the device may have a rigid frame for securing the bag. The rigid frame and the bag are adapted to be inserted through and removed from the opening without the rigid frame and the bag contacting the opening. The rigid frame may be adapted to hold a bag with a flat shape or a plurality of individual flat bags. The rigid frame may be provided in a zig-zag shape and the bag may be adapted to fit inside the zig-zag shaped rigid frame. The zig-zag shaped rigid frame may be adapted to fold flat so that it can be stored, sold or transported in a flattened position.

Accordingly, it is a principal object of the invention to provide a device for making a beverage in a container.

It is another object of the invention to provide a device for making a beverage in a container where the device is reusable.

It is a further object of the invention to provide a device for making a beverage in a container where the device is recyclable.

Still another object of the invention is to provide a device for making a beverage in a container where the device is adapted for a single use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
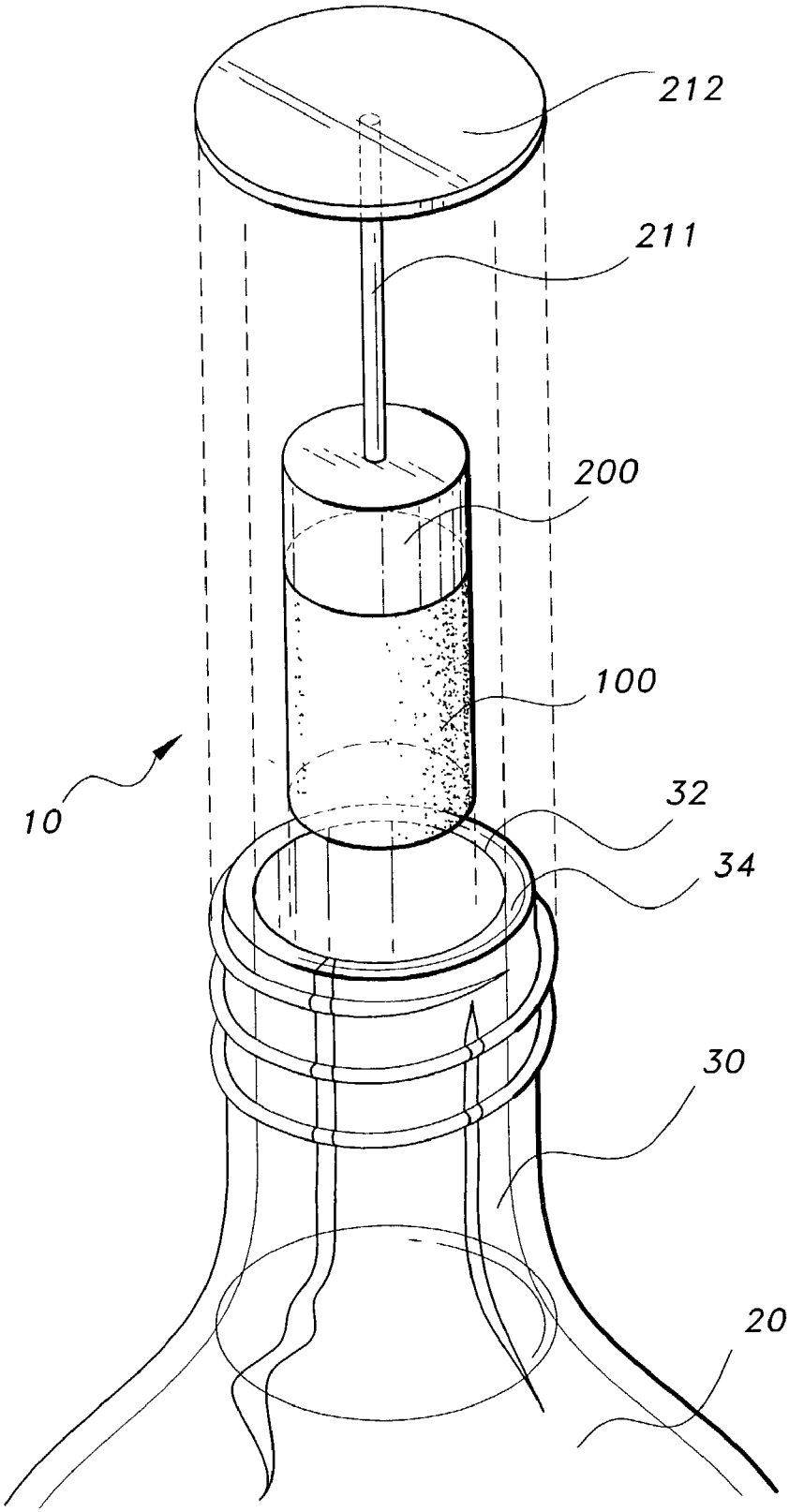
FIG. 1 is an exploded, environmental, perspective view of a device for making a beverage according to the present invention in a first embodiment.

The present invention is a device for making a beverage in a container, designated generally as 10 in the drawings. The device 10 may be reusable, recyclable or adapted for a single use. As shown in FIG. 1, the device 10 is provided for making a beverage 20 in a container 30. The beverage 20 to be made may include tea, and drinks made from drink mixes including powdered or solid drink mixes, drink flavorings and the like. The container 30 may be any suitable container for making a beverage 20. The container 30 may be a new or used container including but not limited to plastic, glass or paper soda bottles, milk jugs, juice containers and the like, all of which come in a variety of shapes and sizes. The device 10 comprises a bag 100 for holding a beverage component 40, and a means for securing the bag 100 in the container 30, such as a bag receiver 200.

In a first embodiment of the invention, the bag receiver 200 may further comprise a shaft 211 and a planar element 212 which may be adapted to rest on a top surface 34 of an opening 32 of the container 30. The length of the shaft 211 is desirably sufficient to submerge the bag 100 in the beverage 20. The length of the shaft 211 may extend so that the device 10 reaches the bottom of the container 30. The planar element 212 may be provided in any shape so long as it has sufficient size and thickness to support the device 10 on the top surface 34 of the opening 32 of the container 30. Although shown as a circular disc shape, the planar element 212 could be any other suitable shape.

The bag 100 may be made of any suitable material, such as paper, hemp, metal mesh, plastic mesh, or stainless steel mesh, which facilitates the mixing of liquid with the contents of the bag 100. The beverage component 40 may include tea leaves, drink mixes including powdered or solid drink mixes, drink flavorings and the like. The means for securing may be made of any suitable material, such as plastic, particularly extruded or blow molded plastic. In other embodiments, the means of securing may be a string (not shown) attached to the bag 100. The means for securing will be discussed in greater detail below (see discussion of FIGS. 12–16).

The container 30 has an opening 32 (or mouth) with a first cross-sectional area which is measured from the inside surface of the opening 32 in a direction perpendicular to the longitudinal axis of the container 30. The bag 100 has a second cross-sectional area which is measured from the outside surface of the bag 100 in a direction perpendicular to the longitudinal axis of the bag 100. The first cross-sectional area of the opening 32 is larger than the second cross-sectional area of the bag 100; therefore, the bag 100 is adapted to be inserted through and removed from the opening 32 without the bag 100 contacting the opening 32. The bag 100 may be provided in any suitable, shape, such as a cylindrical shape, so long as the first cross-sectional area is larger than the second cross-sectional area.

The bag 100 preferably does not expand beyond the size of the opening 32 when exposed to water. The container 30 may be a standard two liter bottle, and the opening 32 may be a standard opening for the standard two liter bottle. The device 10 may be adapted to fit through the standard opening for the standard two liter bottle. The standard opening for the two liter bottle is about ⅞" in diameter; therefore, the largest dimension of the second cross-sectional area should be shorter than the diameter of the standard opening. For a generally cylindrical bag 100, the diameter of the bag 100 should be shorter than the diameter of the standard opening.

Figure 2:
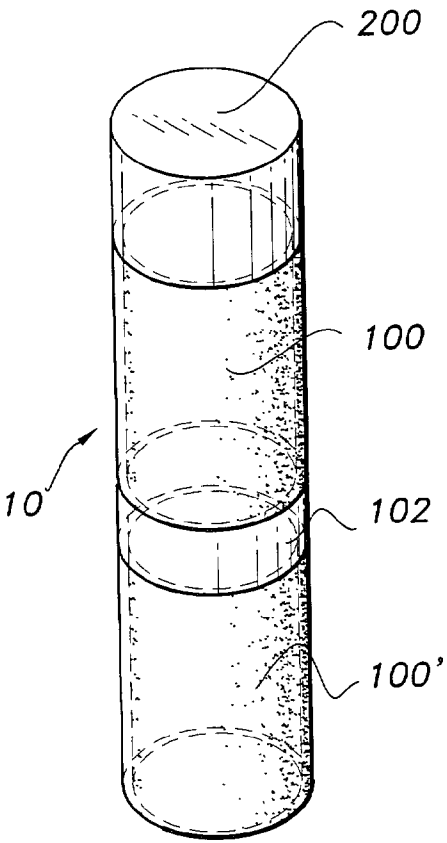
FIG. 2 is an environmental, perspective view of a second embodiment of the device showing a supplemental attachment device.

As shown in FIG. 2, the bag 100 may further comprise a supplemental attachment device 102 for attaching the bag 100 to a supplemental bag 100' in series. The supplemental attachment device 102 may be made of any suitable material which functions to connect the bag 100 and the supplemental bag 100'. The supplemental attachment device 102 may be, for instance, a frangible or perforated connector (similar to FIG. 4), a threaded connector (similar to FIG. 7), a snap fit connector (similar to FIG. 8), a ball and socket or male-female connector (similar to FIG. 9), a clipped connector (similar to FIG. 10), a hook and hole connector (similar to FIG. 11), or the like. The supplemental bag 100' may be any suitable shape and made of any suitable material which facilitates the mixing of liquid with the contents of the supplemental bag 100'.

The supplemental attachment device 102 and the supplemental bag 100' have cross-sectional areas (not shown) which are measured from the outside surface of the supplemental attachment device 102 and the supplemental bag 100' in a direction perpendicular to the longitudinal axis of the supplemental attachment device 102 and the supplemental bag 100'. The cross-sectional area of supplemental attachment device 102 and the supplemental bag 100' should also be less than the first cross-sectional area of the opening 32. By providing the device 10 with the supplemental attachment device 102 and the supplemental bag 100', a user can adjust the strength of the resulting beverage 20 and/or provide a sufficient amount of beverage component 40 for a particular size batch of beverage 20. For example, a single bag 100 may be desirable for a single serving, a single bag 100 and one supplemental bag 100' for a double-strength individual serving, or several supplemental bags 100' for a family size batch of the desired beverage 20.

Figure 3:
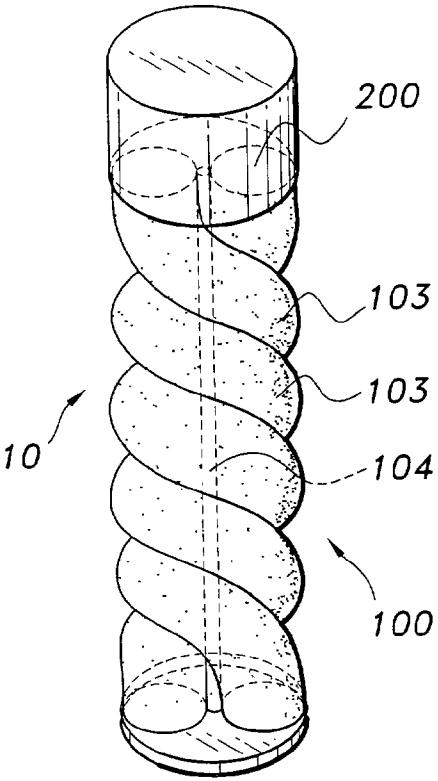
FIG. 3 is an environmental, perspective view of a third embodiment of the device showing a plurality of compartments which are wound about a shaft.

As shown in FIG. 3, the bag 100 may comprise a plurality of compartments 103 which are wound about a shaft 104. The overall shape of the bag 100 remains generally cylindrical. The plurality of compartments 103 may also be generally cylindrical in shape and are wound around the shaft 104 and attached to the bottom end of the shaft 104. By providing the device 10 with the plurality of compartments 103 wound about the shaft 104, the overall surface area of the bag 100 is increased and more of the beverage component 40 is exposed to the liquid when making the beverage 20.

Figure 4:
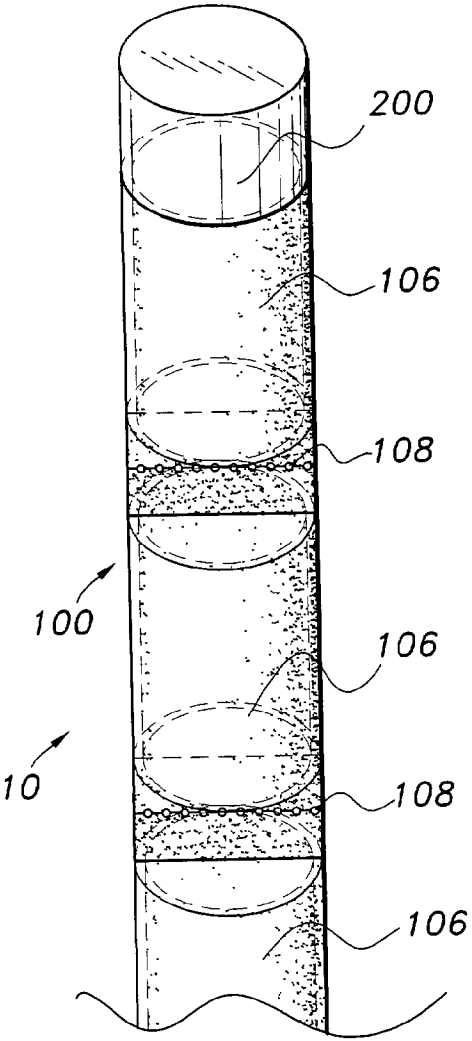
FIG. 4 is an environmental, perspective view of a fourth embodiment of the device showing a perforated connector.

As shown in FIG. 4, the bag 100 may comprise a plurality of units 106 with a frangible or perforated connector 108 between each unit. As with the supplemental attachment device 102 and the supplemental bag 100' above, by providing the device 10 with the plurality of units 106 with the frangible or perforated connector 108 between each unit, a user can adjust the strength of the resulting beverage 20 by tearing off the desired number of units 106 from a roll or package of units 106. A single unit 106 may be desirable for a single serving of beverage 20, two units 106 for a double-strength individual serving, or several units 106 for a family size batch of the desired beverage 20.

Figure 5:
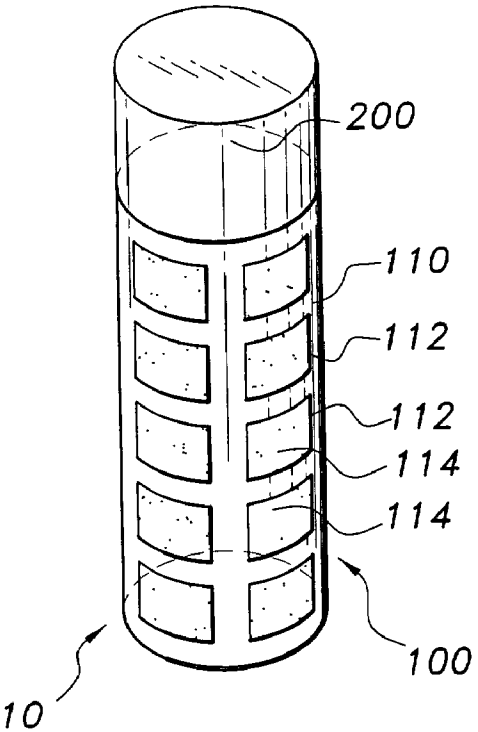
FIG. 5 is an environmental, perspective view of a fifth embodiment of the device showing a rigid container.

As shown in FIG. 5, the device 10 may further comprise a rigid container 110 with a plurality of openings 112. The bag 100 may be adapted to fit inside the rigid container 110. The rigid container 110 is particularly advantageous when used with beverage components that tend to expand and settle when mixed with a liquid, such as tea leaves. Unlike paper bags, the rigid container would not expand laterally. The rigid container 110 thus facilitates removal of the rigid container 110 from the opening 32 after making the beverage 20. The plurality of openings 112 may be covered with a porous material 114. The porous material 114 may be the bag 100 itself. The rigid container 110 may be formed of any suitable material, such as plastic, and may be of any suitable shape, such as a generally cylindrical shape. The openings 112 formed in the rigid container 110 allow liquid to mix with the beverage component 40. The openings 112 are covered on the inside surface of the rigid container 110 with the porous material 114, such as paper, hemp, metal mesh, plastic mesh, or stainless steel mesh. The rigid container 110 may further comprise a plurality of vertically arranged sub-compartments (not shown) Because the beverage component 40 in the rigid container 110 tends to settle to the bottom of the rigid container 110 when introduced into a liquid, the vertically arranged sub-compartments would further promote mixing of the beverage component 40 with the liquid.

Figure 6:
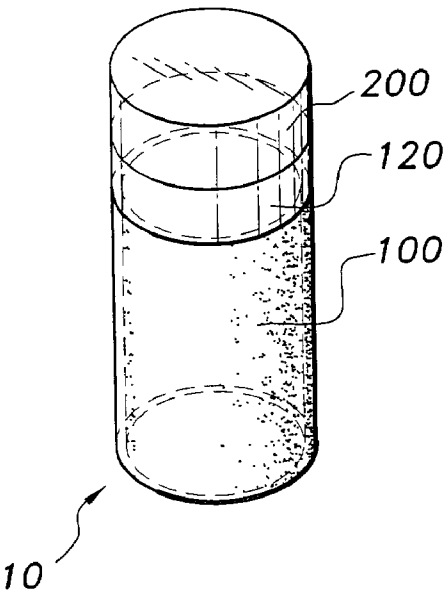
FIG. 6 is an environmental, perspective view of a sixth embodiment of the device showing a connector for connecting the bag to the means for securing.

As shown in FIG. 6, the device 10 may further comprise a connector 120 for connecting the bag 100 to the means for securing. The connector 120 may be made of any suitable material. The connector 120 may be, for instance, a frangible or perforated connector (similar to FIG. 4), a threaded connector (FIG. 7), a snap fit connector (FIG. 8), a ball and socket or male-female connector (FIG. 9), a clipped connector (FIG. 10), a hook and hole connector (FIG. 11), or the like. As shown in FIGS. 7–11, the connector 120 may comprise a two piece connector with an upper member 121 attached to the means for securing and a lower member 122 attached to the bag 100. The upper and lower members 121, 122 may be reversed, i.e. the upper member 121 may be attached to the bag 100 and the lower member 122 may be attached to the means for securing.

Figure 7:
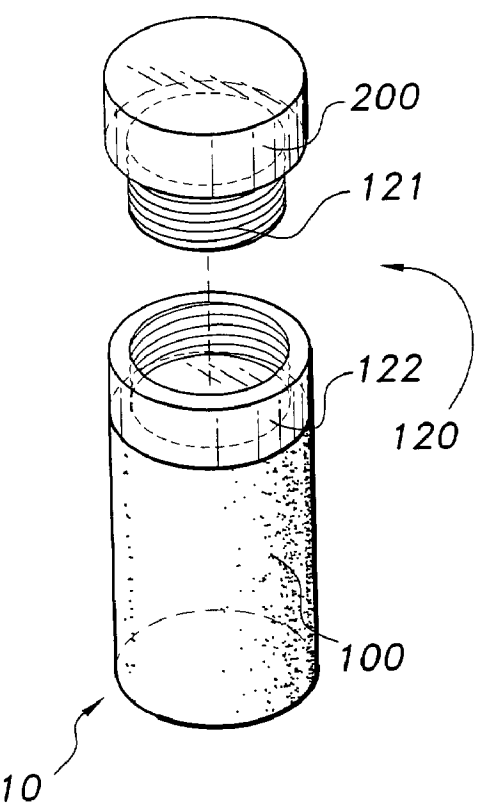
FIG. 7 is an exploded, environmental, perspective view of a seventh embodiment of the device showing a threaded connector.

As shown in FIG. 7, the connector 120 may be in threaded connection with the means for securing. For example, the upper member 121 may be provided as a threaded bolt-like connector and the lower member 122 may be provided as a threaded nut-like connector adapted to receive the threaded bolt-like connector, or vice-versa.

Figure 8:
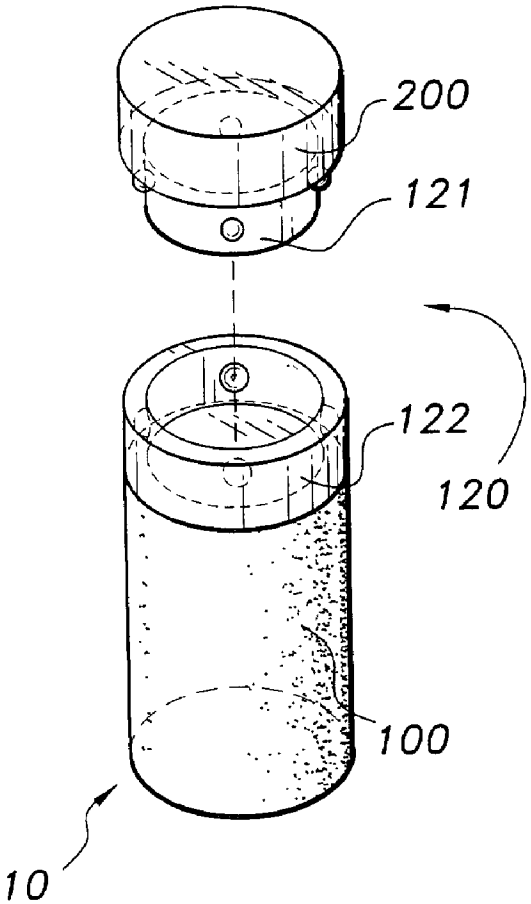
FIG. 8 is an exploded, environmental, perspective view of an eighth embodiment of the device showing a snap fit connector.

As shown in FIG. 8, the connector 120 may be snap fit to the means for securing. For example, the upper member 121 may be provided as a cylindrical member with a plurality of outward extending dimples and the lower member 122 may be provided as a hollow cylindrical member with a plurality of inward extending detents adapted to receive the outward extending dimples, or vice-versa. Alternately, the dimples may be provided on the hollow cylindrical member and the detents may be provided on the cylindrical member. Although the upper member 121 is shown with a relatively large diameter a relatively short axial length, the upper member 121 may be provided as a shaft with a relatively small diameter and a relatively long axial length, and the lower member 122 may be adapted to receive the shaft in a snap fit connection.

Figure 9:
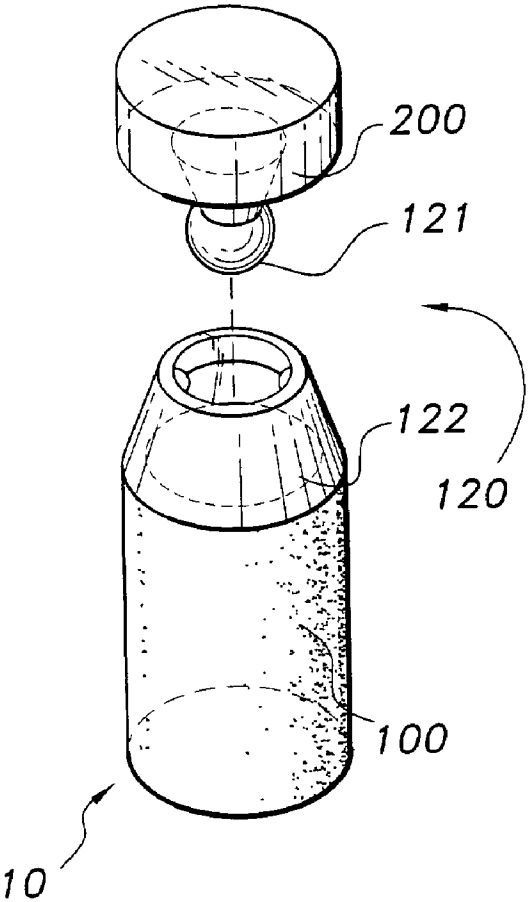
FIG. 9 is an exploded, environmental, perspective view of a ninth embodiment of the device showing a ball and socket or male-female connector.

As shown in FIG. 9, the connector 120 may have a ball and socket or male-female connector with the means for securing. For example, the upper member 121 may be provided as a ball-shaped member and the lower member 122 may be provided as a socket-shaped member adapted to receive the ball-shaped member, or vice-versa. The ball and socket connector permits a range of motion. If several bags are connected together in series, the range of motion of the ball and socket connector between each bag permits the several bags to coil up at the bottom of the container 30. This is particularly advantageous for making a stronger strength beverage 20.

Figure 10:
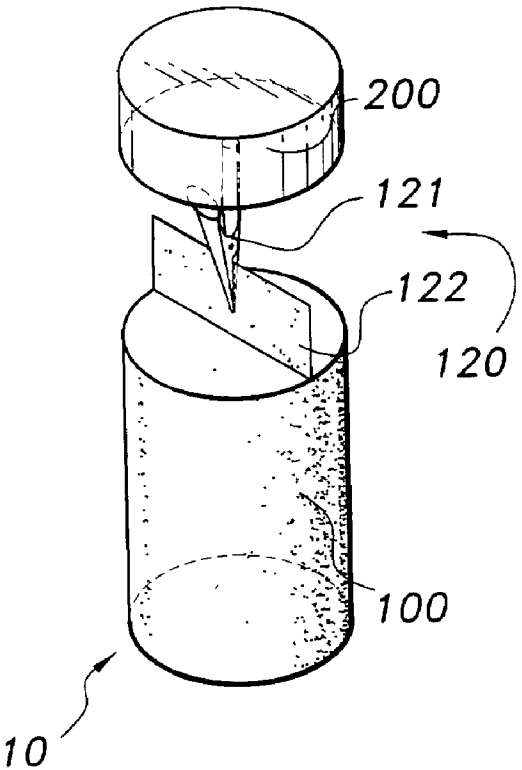
FIG. 10 is an environmental, perspective view of a tenth embodiment of the device showing a clipped connector.

As shown in FIG. 10, the connector 120 may be clipped to the means for securing. For example, the upper member 121 may be provided as a clip, such as a clothes-pin like connector, and the lower member 122 may be provided as tab adapted to by held by the clip, or vice-versa.

In any of the embodiments of FIGS. 7–10, the lower member 122 may be provided to be hollow and the bag 100 may be provided with an open top end so that the bag 100 could be refilled and reused.

Figure 11:
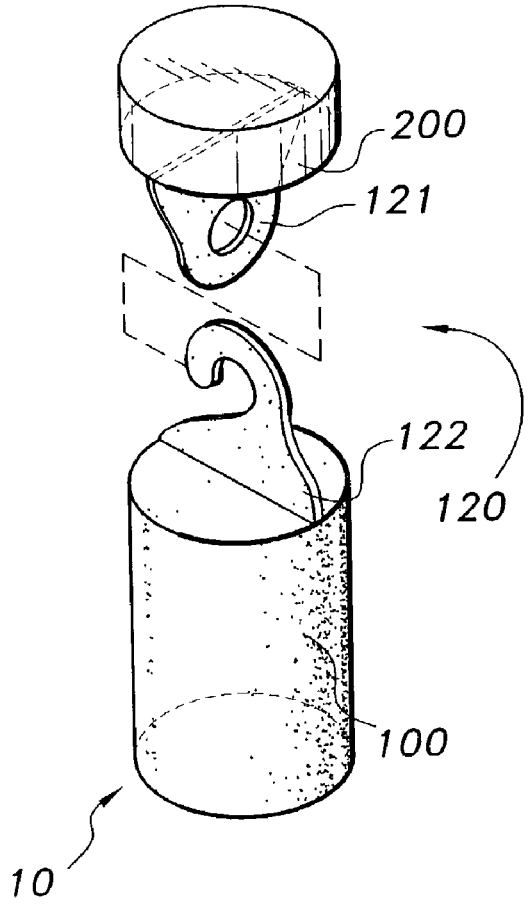
FIG. 11 is an exploded, environmental, perspective view of a eleventh embodiment of the device showing a hook and hole connector.

As shown in FIG. 11, the connector 120 may comprise a hook and hole connector with the means for securing. For example, the upper member 121 may be provided as a tab with a hole, and the lower member 122 may be provided as a hanger adapted to fit through the hole, or vice-versa. The hook may be angled inwardly so that the bag 100 is held securely. The inward angle of the hook is particularly advantageous when the bag 100 tends to float in the liquid. Alternately, the upper member 121 may be provided as a tab with a hole, and the lower member 122 may be provided as a T-shaped tab which fits through the hole, or vice-versa. In this embodiment, the T-shaped tab is similar to the type used to attach price tags to clothing.

Figure 12:
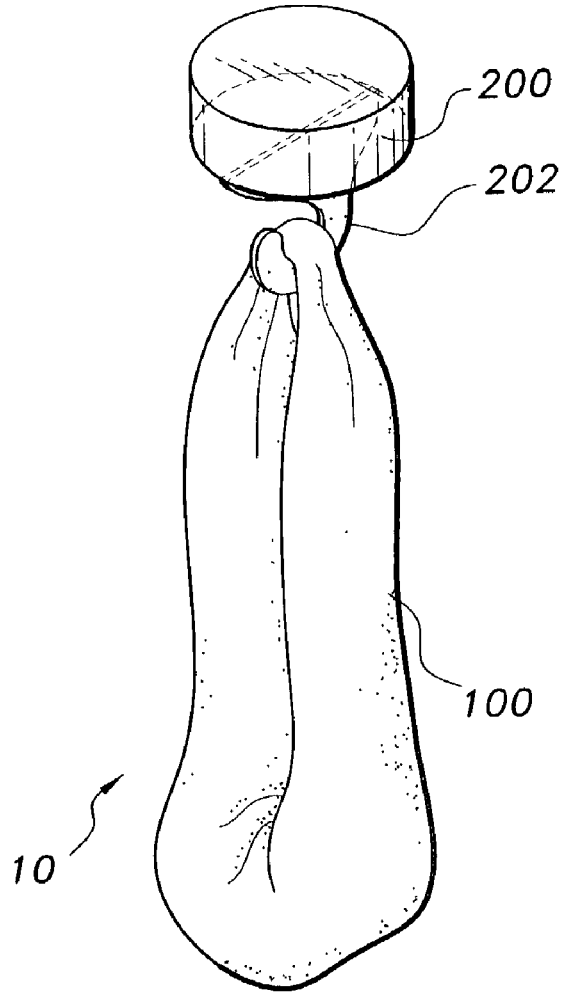
FIG. 12 is an exploded, environmental, perspective view of a twelfth embodiment of the device showing a means for securing comprising a hook and a bag hung from the hook.

As shown in FIG. 12, the means for securing may comprise a hook 202 and the bag 100 is hung from the hook 202. In this embodiment, the bag 100 may be provided in a loop shape which is adapted to be hung from the hook 202. As with the hook and hole connector above, the hook 202 may be angled inwardly so that the bag 100 is held securely so as to prevent the bag 100 from floating up and off of the hook 202.

Figure 13:
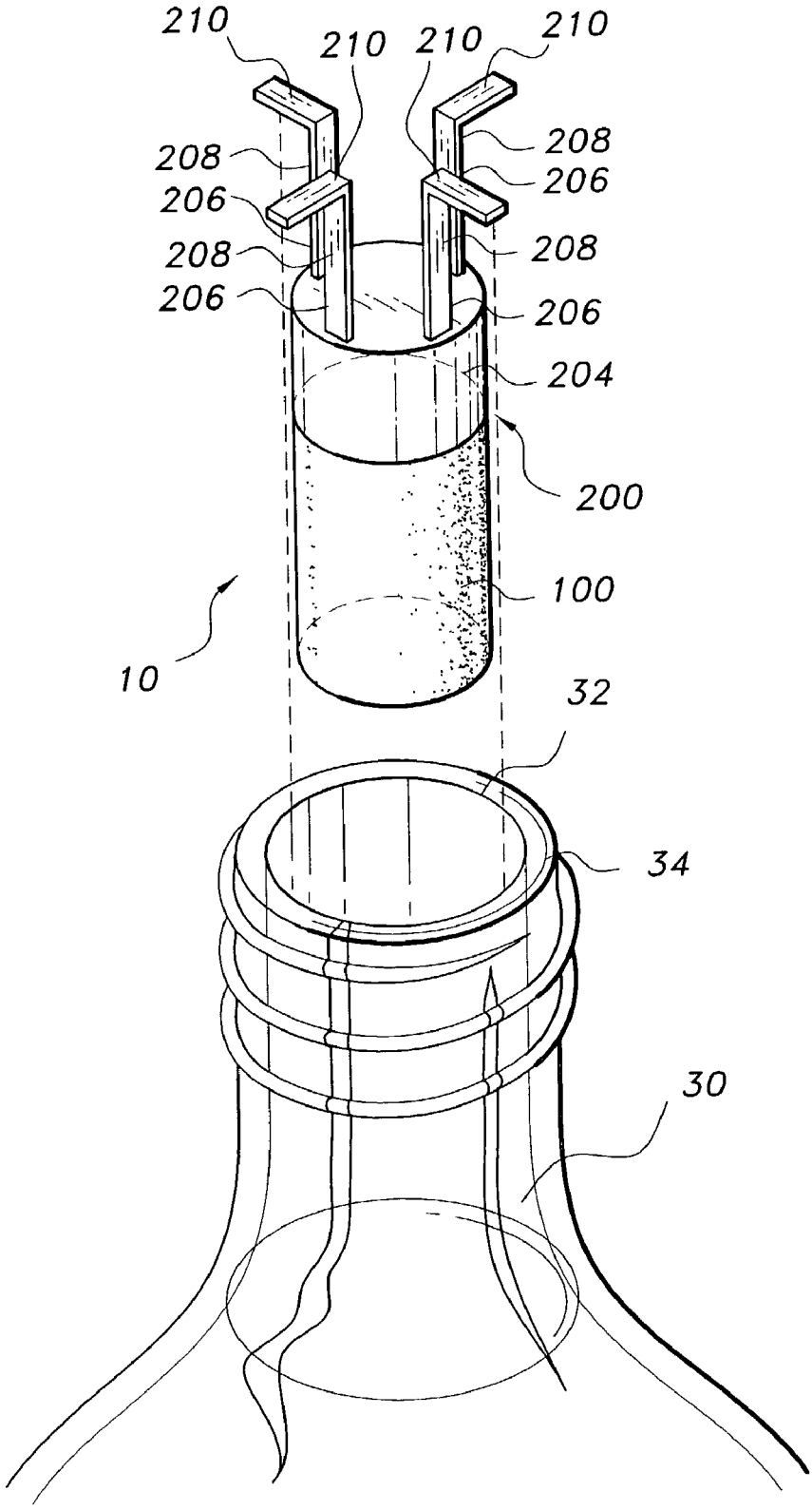
FIG. 13 is an exploded, environmental, perspective view of a thirteenth embodiment of the device showing a means for securing comprising a generally cylindrical base and a plurality of axially and radially extending fingers.

As shown in FIG. 13, the means for securing may comprise a generally cylindrical base 204 and a plurality of axially and radially extending fingers 206 which is adapted to fit a wide variety of container openings. Each finger of the plurality of fingers 206 comprises an axial portion 208 which extends axially upward from the base 204 and a radial portion 210 which extends radially outward from the axial portion 208. The radial portion 210 rests on a top surface 34 of the opening 32 of the container 30 while permitting the bag 100 to be inserted through and removed from the opening 32 (as discussed in greater detail above with respect to FIG. 1). The plurality of fingers 206 may be provided with a pre-stress or bias in the radially outward direction to further secure the bag 100 and the means for securing in the container 30. The length of the radial portion 210 may be adjusted to adapt the device 10 to hang inside any size opening 32.

Figure 14:
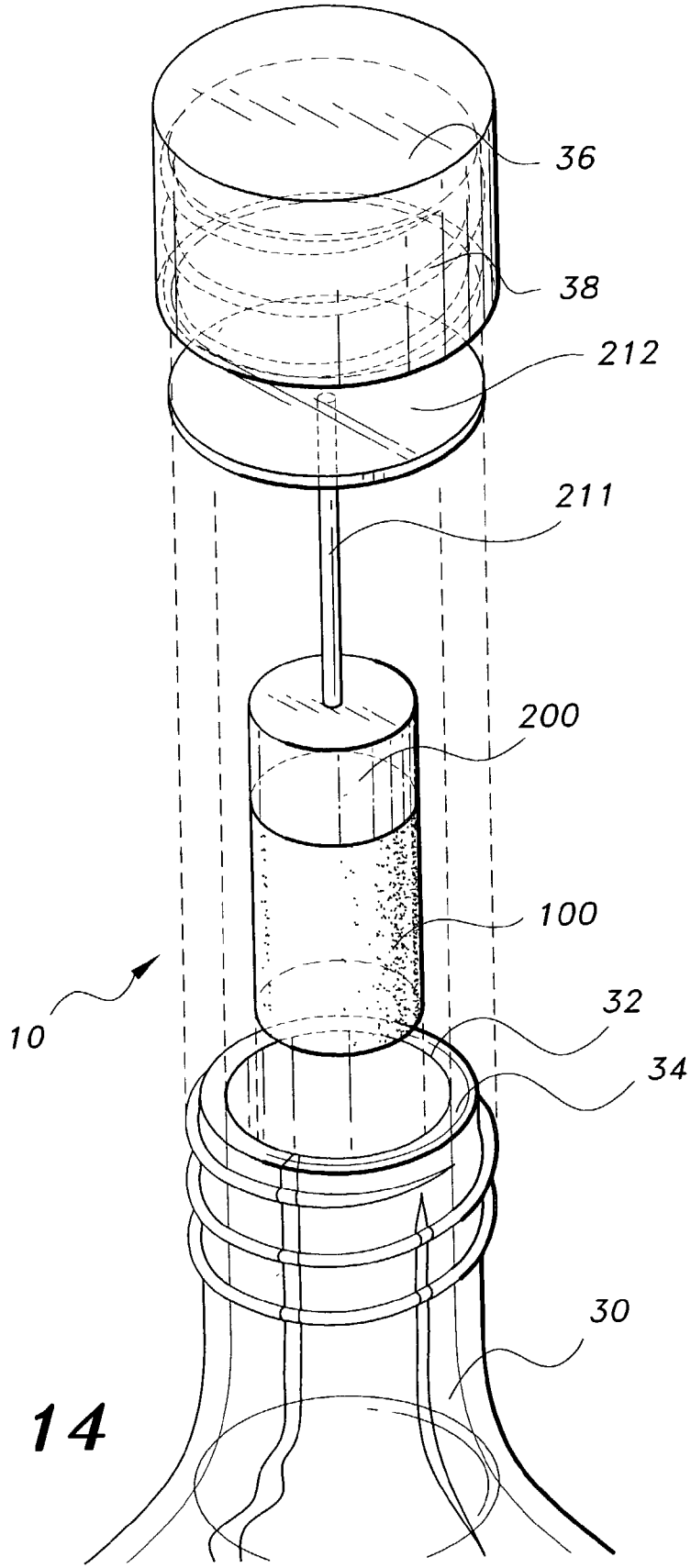
FIG. 14 is an exploded, environmental, perspective view of a fourteenth embodiment of the device showing a means for securing comprising a planar element which may be adapted to fit inside a cap for a container.

As shown in FIG. 14, the means for securing may comprise a planar element 212. The planar element 212 may be attached to the bag receiver 200 via a shaft 211. The planar element 212 may be adapted to fit inside a cap 36 for the container 30. The planar element 212 may be provided in any shape so long as it has sufficient size and thickness to support the device 10. Although shown as a circular disc shape, the planar element 212 could be any other suitable shape. The cap 36 may comprise threads 38, and the planar element 212 is adapted to slide past the threads 38 of the cap 36 and nest inside the grooves that correspond with the threads 38 of the cap 36. In other words, the planar element 212 is large enough to rest inside the grooves of the threads 38, but small enough to flexibly slide past the grooves. In order to facilitate the installation of the planar element 212 in the cap 36, the center of the planar element 212 may be made of a slightly harder material than a flexible outer periphery of the planar element 212. Alternately, the flexible outer periphery of the planar element 212 may comprise a plurality of semi-circular tabs which extend into the grooves of the threads 38. After the planar element 212 is inserted into the cap 36, the cap 36 may be secured and tightened onto the container 30 thus sealing the planar element 212 against the container 30. If the cap 36 is not provided with threads, the planar element 212 may be provided to be adapted to frictionally engage with the inside surface of the cap 36 so as to securely hold the device 10 inside the container 30. In one preferred embodiment of the invention for use with a standard two liter bottle, the planar element 212 has a diameter of between ⅞" and 1¼", preferably about 1".

Figure 15:
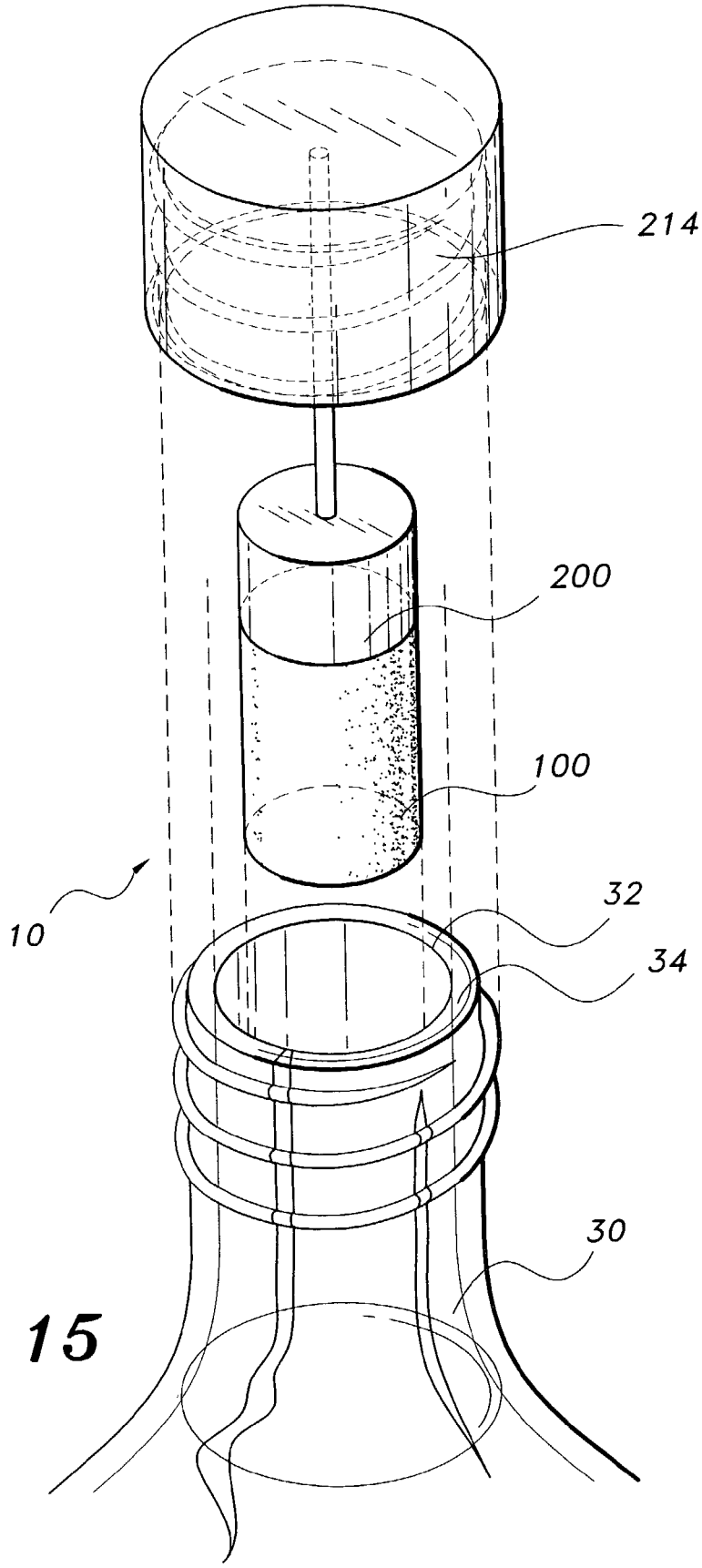
FIG. 15 is an exploded, environmental, perspective view of a fifteenth embodiment of the device showing a means for securing comprising a replacement cap which is adapted to fit a container.

As shown in FIG. 15, the means for securing may comprise a replacement cap 214 which is adapted to fit the container 30. The replacement cap 214 may be attached to the body of the means for securing 200 via a shaft. The replacement cap 214 may be provided as a substitute for any standard container cap. For instance, the replacement cap 214 may be adapted to fit a standard two liter bottle, a milk jug, or any type of container used to hold liquids. The replacement cap 214 may be adapted to connect with the threads of the container 30. Alternately, the replacement cap 214 may be adapted to have a compression fit in or over the opening 32 of the container 30.

Figure 16:
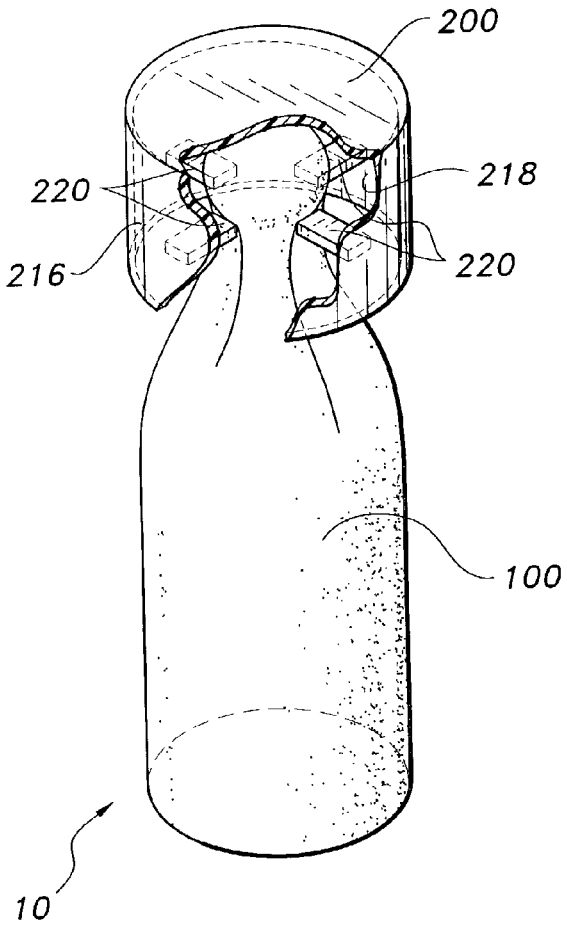
FIG. 16 is an environmental, perspective view of a sixteenth embodiment of the device showing a means for securing comprising a hollow cylindrical member with an axially inner surface with a plurality of flexible inwardly extending fins adapted to catch and releasably hold a bag.

As shown in FIG. 16, the means for securing may comprise a hollow cylindrical member 216 with an axially inner surface 218. A plurality of flexible inwardly extending fins 220 are provided radially on the axially inner surface 218, and the fins 220 are adapted to catch and releasably hold the bag 100. The fins 220 may be angled in a slightly upward direction to further facilitate reception of the bag 100. For example, a user may press, with a finger, an upper portion of the bag 100 through the fins 220. After the beverage 20 has been made, the user can remove the bag 100 from the fins 220 and reuse the means for securing.

Figure 17:
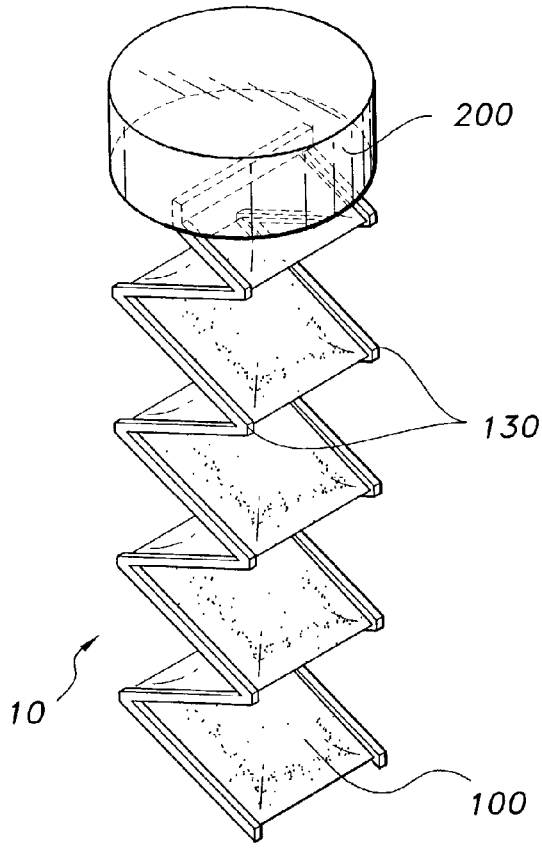
FIG. 17 is an environmental, perspective view of a seventeenth embodiment of the device showing a rigid frame for securing the bag.

As shown in FIG. 17, the device 10 may have a rigid frame 130 for securing the bag 100. The rigid frame 130 and the bag 100 are adapted to be inserted through and removed from the opening 32 without the rigid frame 130 and the bag 100 contacting the opening 32. The rigid frame 130 may be made of any material, such as plastic, which is suitable for holding the bag 100 in place. The rigid frame 130 may be adapted to hold a bag with a flat shape or a plurality of individual flat bags. The rigid frame 130 may be provided in a zig-zag shape and the bag 100 may be adapted to fit inside the zig-zag shaped rigid frame 130. The zig-zag shaped rigid frame 130 is advantageous in that it increases the total surface area of the bag 100 and provides for a more compact device 10. The zig-zag shaped rigid frame 130 may be adapted to fold flat so that it can be stored, sold or transported in a flattened position.

Figure 18:
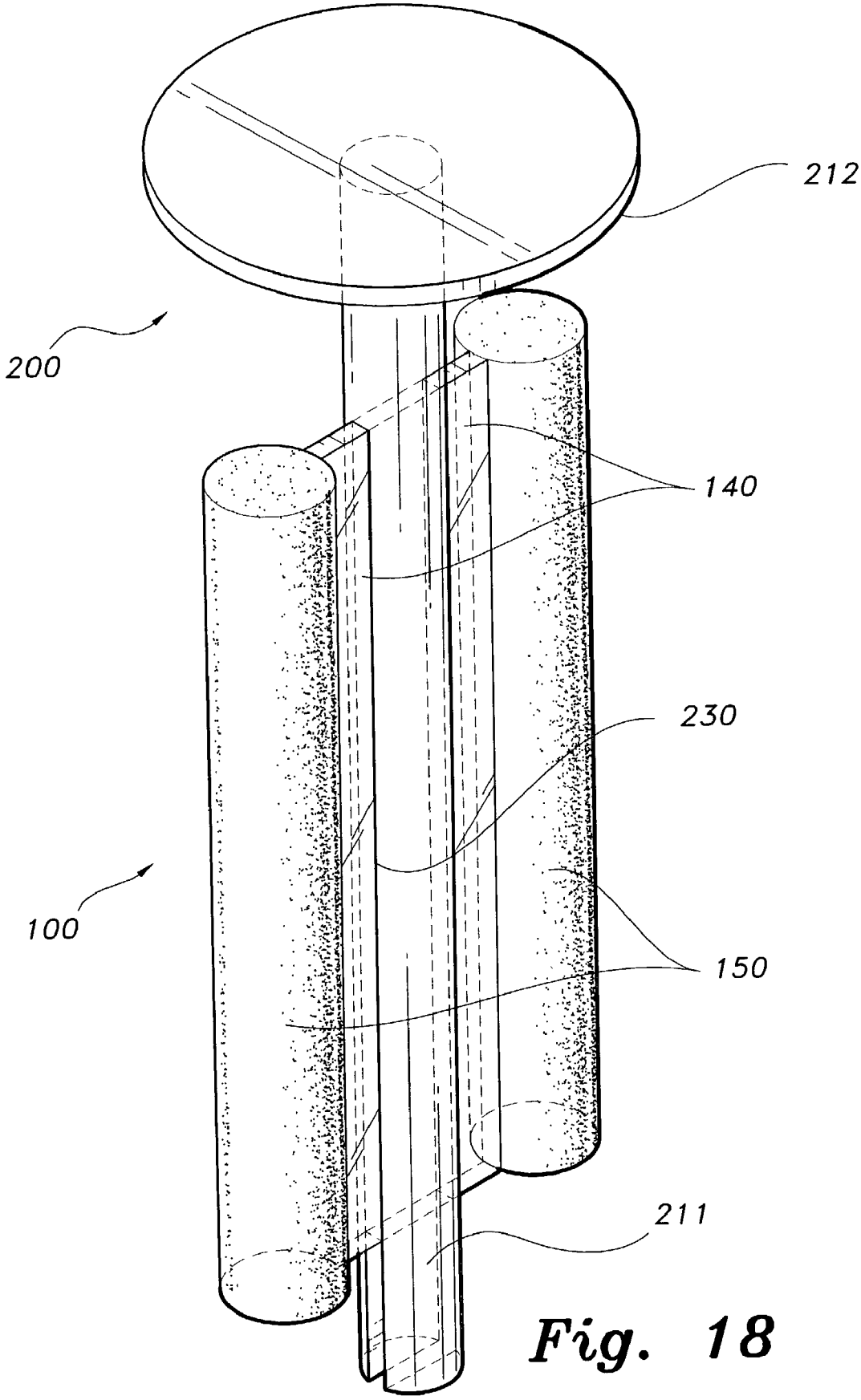
FIG. 18 is an environmental, perspective view of an eighteenth embodiment of the device showing a shaft with a slot for receiving a bag with a tab.

As shown in FIG. 18, a bag receiver 200 is provided with a planar element 212 and shaft 211 as described in detail above. The shaft 211 has an axial slot 230 extending from the lower end of said shaft 211. The bag 100 of this embodiment of the invention may have at least one sub-compartment 150, and two such sub-compartments are shown in FIG. 18, although a single sub-compartment or a plurality may be provided. The at least one sub-compartment 150 may be provided in any suitable shape, such as a cylindrical shape, a half-cylindrical shape, or a rectangular shape. The bag 100 is attached to a tab 140 using any suitable means of attachment. The tab 140 may be made of any suitable material, such as paper or plastic. One or more portions of the tab 140 may extend in a radial direction (not shown) to further support the bag 100. The axial slot 230 is adapted to receive the tab 140. The width of the axial slot 230 may be provided such that the axial slot 230 frictionally secures the bag in place during operation. The axial slot 230 and tab 140 may also utilize a snap fit, ball and socket, or male-female connection. The shaft 211 with the axial slot 230 provides the bag. This is an improvement over conventional beverage devices, such as tea bags, which have a tendency to float on the surface of the beverage.

It is to be understood that the present invention is not limited to the sole embodiments described above, but encompasses any and all embodiments within the scope of the following claims.

I claim:

1. A device for making a beverage in a container, said device comprising:

a bag adapted for holding a beverage component;

a means for securing attached to said bag;

a shaft attached to said means for securing; and a planar element attached to said shaft;

said bag further comprising a supplemental attachment device for attaching said bag to a supplemental bag in series;

wherein said bag is dimensioned and configured for insertion and removal through said mouth of said container without said bag contacting said mouth.

2. The device according to claim 1, wherein said planar element is adapted for being releasably secured to threads inside a cap covering a mouth of said container; and wherein said planar element is adapted to fit inside said threads of said cap.

3. The device according to claim 1, wherein said container is a standard two liter bottle; and wherein said opening is a standard opening for said standard two liter bottle.

4. The device according to claim 1, wherein said supplemental attachment device is one from the group consisting of a frangible connector, a threaded connector, a snap fit connector, a ball and socket connector, a male-female connector, a clip and tab connector, and a hook and hole connector.

5. The device according to claim 1, wherein said bag comprises a plurality of units with a frangible connector between each unit.

6. The device according to claim 1, wherein said device further comprises a rigid container with a plurality of openings;

wherein said plurality of openings are covered with a porous material.

7. The device according to claim 1, wherein said device further comprises a connector for connecting said bag to said means for securing.

8. The device according to claim 7, wherein said connector is one from the group consisting of a frangible connector, a threaded connector, a snap fit connector, a ball and socket connector, a male-female connector, a clip and tab connector, and a hook and hole connector.

9. The device according to claim 1, wherein said device further comprises a replacement cap which is adapted to fit said container.

10. A device for making a beverage in a container, said device comprising:

a bag adapted for holding a beverage component;

a means for securing attached to said bag;

a shaft attached to said means for securing; and a planar element attached to said shaft;

wherein said bag is dimensioned and configured for insertion and removal through said mouth of said container without said bag contacting said mouth; and wherein said bag comprises a plurality of compartments which are wound about a shaft.

11. A device for making a beverage in a container, said device comprising:

a bag adapted for holding a beverage component;

a means for securing attached to said bag;

a shaft attached to said means for securing;

a planar element attached to said shaft;

said means for securing comprising a hollow cylindrical member with an axially inner surface, and a plurality of inwardly extending fins disposed on said axially inner surface;

wherein said bag is secured to said means for securing by said plurality of inwardly extending fins; and wherein said bag is dimensioned and configured for insertion and removal through said mouth of said container without said bag contacting said mouth.

12. The device according to claim 11, wherein said plurality of inwardly extending fins are adapted to releasably hold said bag.

13. A device for making a beverage in a container, said device comprising:

a bag adapted for holding a beverage component;

a means for securing attached to said bag;

a shaft attached to said means for securing;

a planar element attached to said shaft;

said bag further comprising a tab attached to said bag; and said shaft having an axial slot extending from the lower end of said shaft;

wherein said axial slot is adapted to receive said tab of said bag; and wherein said bag is dimensioned and configured for insertion and removal through said mouth of said container without said bag contacting said mouth.

14. A device for making a beverage in a container, comprising:

a bag adapted for holding a beverage component, said bag having a supplemental attachment device for attaching said bag to a supplemental bag in series; and means for securing said bag in said container;

said means for securing comprises a base and a plurality of fingers, each finger of said plurality of fingers comprising an axial portion which extends axially upward from said base and a radial portion which extends radially outward from said axial portion;

wherein said bag is dimensioned and configured for insertion and removal through a mouth of said container without said bag contacting said mouth.

15. The device according to claim 14, wherein said radial portion rests on a top surface of said opening of said container.

16. A device for making a beverage in a container, said device comprising:

a bag adapted for holding a beverage component;

a rigid frame having a zig-zag shape;

a means for securing said bag and said rigid frame in said container;

wherein said rigid frame is attached to said means for securing, and said bag is disposed inside said rigid frame; and wherein said rigid frame and said bag are adapted to be inserted through and removed from said opening without said rigid frame and said bag contacting said opening.

* * * * *